US011845638B2

(12) United States Patent
Fridmann

(10) Patent No.: US 11,845,638 B2
(45) Date of Patent: Dec. 19, 2023

(54) METHOD FOR INSTALLING AN ELEVATOR SYSTEM

(71) Applicant: Inventio AG, Hergiswil (CH)

(72) Inventor: Robert Fridmann, Boubiers (FR)

( * ) Notice: Subject to any disclaimer, the term of this patent is extended or adjusted under 35 U.S.C. 154(b) by 180 days.

(21) Appl. No.: 17/309,149

(22) PCT Filed: Oct. 22, 2019

(86) PCT No.: PCT/EP2019/078636

§ 371 (c)(1),
(2) Date: Apr. 30, 2021

(87) PCT Pub. No.: WO2020/088979

PCT Pub. Date: May 7, 2020

(65) Prior Publication Data

US 2021/0316959 A1 Oct. 14, 2021

(30) Foreign Application Priority Data

Oct. 30, 2018 (EP) ..... 18203391

(51) Int. Cl.
*B66B 9/187* (2006.01)
*B66B 7/04* (2006.01)
*B66B 19/00* (2006.01)

(52) U.S. Cl.
CPC ..... *B66B 9/187* (2013.01); *B66B 7/047* (2013.01); *B66B 19/00* (2013.01)

(58) Field of Classification Search
CPC ..... B66B 7/027; B66B 7/047; B66B 9/16; B66B 9/187; B66B 19/00; B66B 19/002; B66B 19/005; B66B 19/007; B66B 19/04
See application file for complete search history.

(56) References Cited

U.S. PATENT DOCUMENTS 4,345,671 A * 8/1982 Tosato ..... B66B 19/002 52/30
2009/0223751 A1 9/2009 Peacock et al.
2012/0217101 A1* 8/2012 Peacock ..... B66B 11/0045 29/428

(Continued)

FOREIGN PATENT DOCUMENTS

CN 113460842 A * 10/2021 ..... B66B 19/002
FR 2694279 A1 2/1994

(Continued)

*Primary Examiner* — Minh Truong

(74) *Attorney, Agent, or Firm* — William J. Clemens; Shumaker, Loop & Kendrick, LLP

(57) ABSTRACT

A method for installing an elevator system in an elevator shaft of a building in its construction phase uses a machine platform displaceable in the shaft along car guide rails and having a drive machine for moving a suspended elevator car to adapt a usable lifting height of the elevator car to an increasing height of the building by lifting the machine platform to a higher level. The method includes lowering a pre-assembled elevator unit into the shaft by a lifting device, using guide devices that are either mounted on the elevator unit and cooperate with stationarily fixed alignment elements in the shaft, or are fixed in the shaft and cooperate with alignment elements on the elevator unit, to align the unit in a position suitable for fitting guide shoes on the elevator unit and the car guide rails into one another.

15 Claims, 6 Drawing Sheets

(56) References Cited

U.S. PATENT DOCUMENTS

| | | | | |
|---|---|---|---|---|
| 2016/0152442 | A1* | 6/2016 | Weber | B66B 19/005 187/359 |
| 2018/0273349 | A1 | 9/2018 | Weibel et al. | |
| 2021/0245998 | A1* | 8/2021 | Lanz | B66B 19/00 |
| 2023/0020453 | A1* | 1/2023 | Medeiros | B66B 19/00 |

FOREIGN PATENT DOCUMENTS

| | | | | | |
|---|---|---|---|---|---|
| JP | S51109563 | U | | 9/1976 | |
| JP | S6256280 | A | | 3/1987 | |
| JP | H04116079 | A | | 4/1992 | |
| JP | H06135656 | A | | 5/1994 | |
| JP | H09240956 | A | * | 9/1997 | B66B 19/002 |
| WO | 2015003965 | A1 | | 1/2015 | |
| WO | WO-2015003964 | A1 | * | 1/2015 | B66B 19/00 |
| WO | WO-2015003965 | A1 | * | 1/2015 | B66B 19/00 |

* cited by examiner

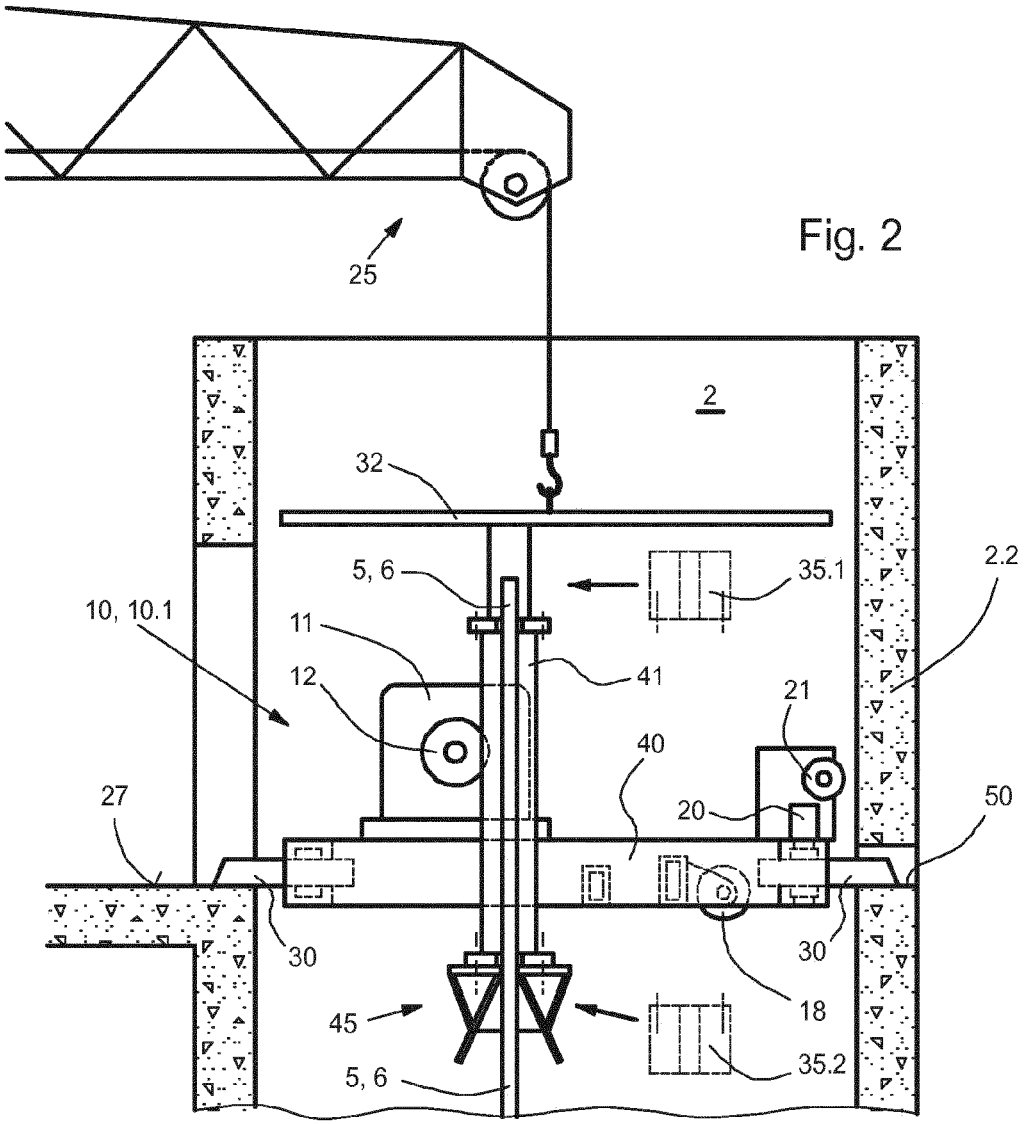
Fig. 2
Fig. 2A
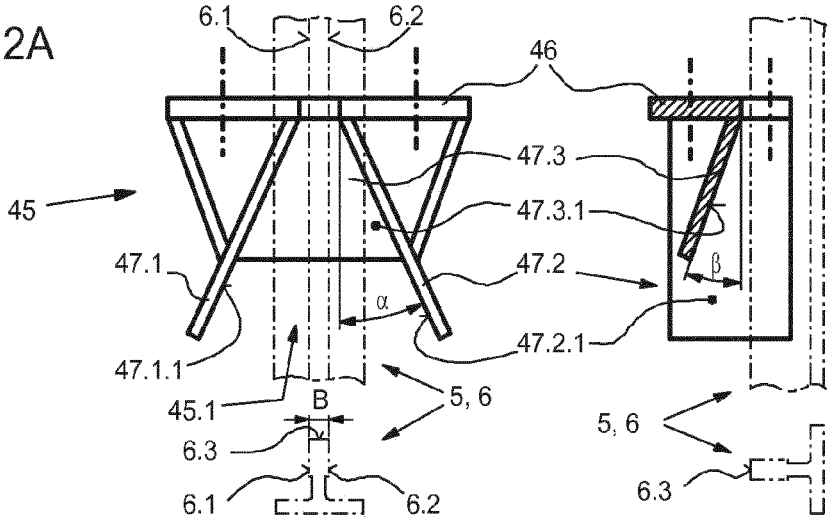
Fig. 2B

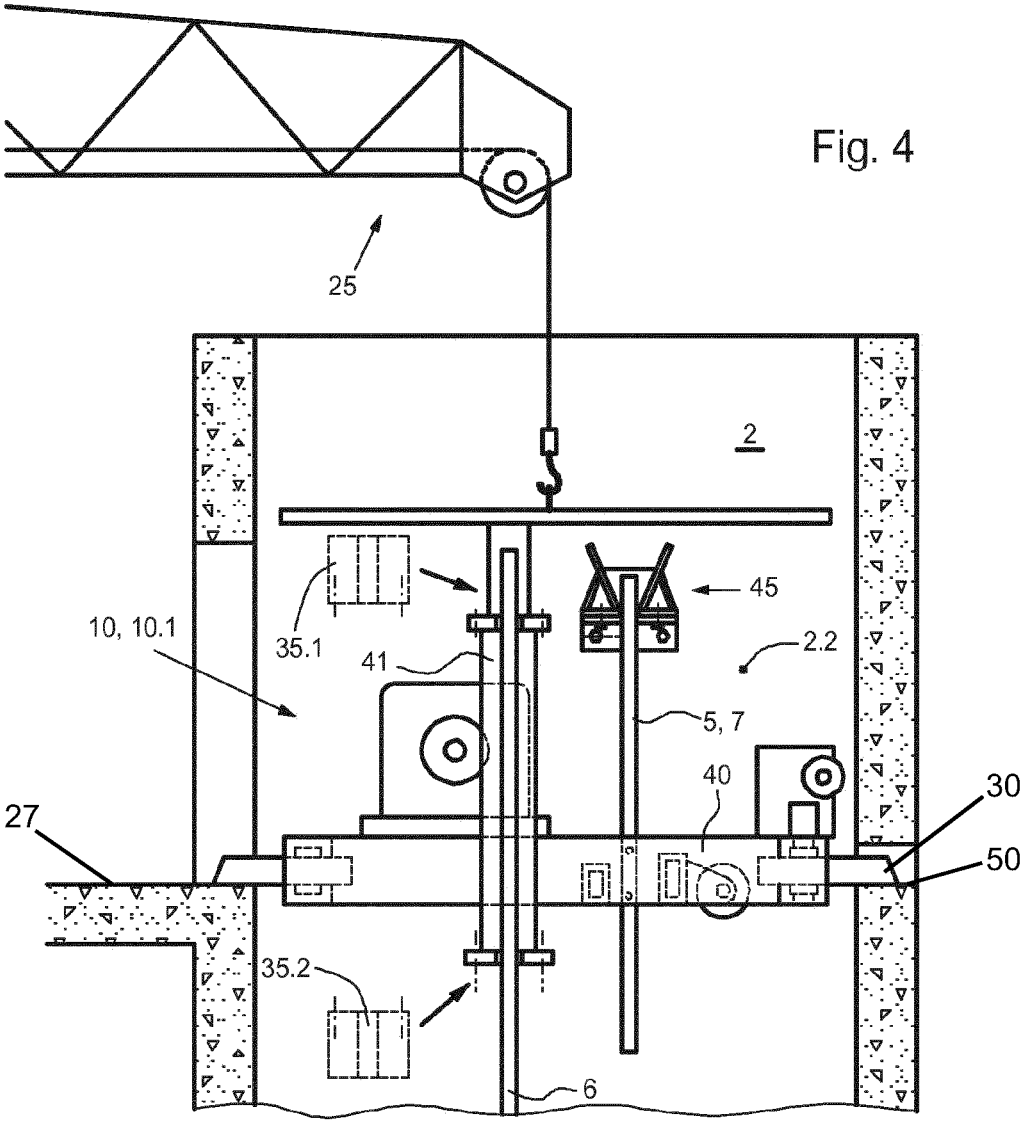
Fig. 4
Fig. 4A
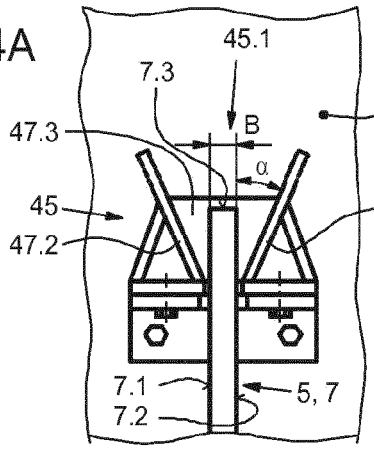
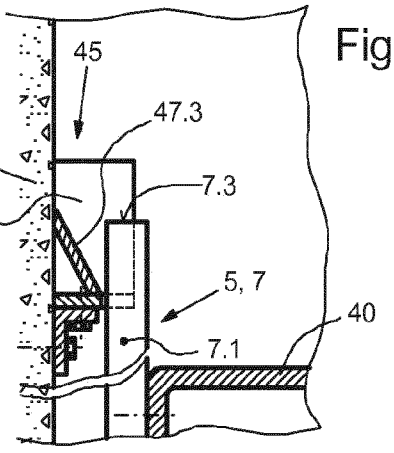
Fig. 4B

METHOD FOR INSTALLING AN ELEVATOR SYSTEM

FIELD

The invention relates to a method for installing an elevator system in an elevator shaft of a building in its construction phase, wherein the elevator system comprises at least one machine platform movable along the elevator shaft and temporarily fixable therein and having an elevator drive machine, and at least one elevator car suspended from the machine platform via suspension means and driven by the elevator drive machine, wherein a usable lifting height of the elevator car is adapted from time to time to an increasing height of the building by performing at least one lifting of the machine platform with the elevator car to a higher level.

BACKGROUND

From FR 2694279 A1, an elevator is known which comprises all elevator units and functions mentioned in the foregoing introduction, wherein in the case of this elevator, a usable lifting height of the elevator car is adapted from time to time to an increasing height of the building during the construction of the building. During the installation of the elevator, elevator units such as the elevator car, the counterweight, and the machine platform equipped with the drive machine are inserted into the elevator shaft already equipped with car guide rails for the elevator car by lowering them by means of a crane, wherein guide rails already installed are inserted into the guide shoes of the elevator units.

From JP H04 116079 A, a method for installing an elevator is known in which the elevator car and counterweight are inserted into the elevator shaft already equipped with guide rails and lowered therein with the aid of a crane. When lowering the elevator car and the counterweight into the elevator shaft, guide devices are fixed to the guide shoes thereof, with the aid of which the guide rails can be inserted more easily into the associated guide shoes.

From JP S62 56280 A, a process is known in which the elevator car of an elevator is inserted by means of a crane into the elevator shaft which is already equipped with guide rails. From supports temporarily mounted above the elevator shaft, at least two vertical ropes are tensioned which extend approximately to the upper ends of the car guide rails. These ropes serve as temporary auxiliary guides for the elevator car when the elevator car is lowered into the elevator shaft and simplify the insertion of the car guide rails into the associated guide shoes of the elevator car.

From JP H06 135656 A, a device is known which is intended to facilitate the guiding of the car guide rails into the guide shoes of the elevator car during the insertion of a prefabricated elevator car into the elevator shaft carried out with the aid of a crane. For this purpose, guide rail portions are fixed to the upper ends of the car guide rails, of which all guide surfaces of the guide web are chamfered in a wedge-shaped manner.

By the aforementioned prior art documents, it is suggested that during the installation of elevators which are adapted from time to time to an increasing height of the building, auxiliary devices, such as guide devices attached to the elevator units to be lowered into the elevator shaft, are used to guide or align the elevator units during lowering in such a manner that during the lowering process, the guide shoes of the elevator units can be brought into engagement with the associated car guide rails or, respectively, with the guide rail heads of these car guide rails.

However, such methods have the disadvantage that the elevator units, which can weigh up to ten tons, must be precisely aligned by hand by elevator fitters during lowering, at least shortly before the guide rails are inserted into the associated guide shoes, because there is only very little play between the guide surfaces of the guide rails and the guide elements of the guide shoes. Otherwise, fitting guide rails and guide shoes into one another very likely results in damage to at least one of the two components. In addition, there is a considerable risk of accidents for the assembly personnel when manually aligning the heavy elevator units.

SUMMARY

An underlying object of the present invention is to provide a method for installing such an elevator system which makes it possible to avoid the problems mentioned, i.e. to lower at least one pre-assembled elevator unit—for example the elevator car or the machine platform—into the elevator shaft without risk of damage, with less expenditure of time and with less risk of accident, and to bring the guide shoes of the elevator unit into engagement with the respective associated car guide rails or, respectively, with the guide rail heads of these car guide rails.

According to the invention, the solution to the object consists in a method for installing an elevator system in an elevator shaft of a building in its construction phase, which elevator system comprises an elevator car guided along the elevator shaft on car guide rails and a machine platform having a drive machine which is displaceable along the elevator shaft on the same car guide rails and can be temporarily fixed in the elevator shaft, wherein the elevator car is suspended from the machine platform via suspension means and is driven by the elevator drive machine, wherein a usable lifting height of the elevator car is adapted from time to time to an increasing height of the building by, among other things, lifting the machine platform to a higher level, wherein in the installation method at least one elevator unit is lowered in a pre-assembled state by means of a lifting device into the elevator shaft already equipped with the car guide rails, wherein guide devices are used which are either mounted on the elevator unit and cooperate with stationarily fixed alignment elements fixed in the elevator shaft or which are fixed in the elevator shaft and cooperate with alignment elements mounted on the elevator unit, so that the at least one elevator unit, when lowered into the elevator shaft, is aligned in a position suitable for fitting guide shoes of the elevator unit and associated car guide rails into one another, and wherein the at least one elevator unit, at the end of its lowering process, is supported in the region of the elevator shaft equipped with car guide rails in the position suitable for fitting guide shoes and car guide rails into one another, whereafter at least one guide shoe of the elevator unit is brought into engagement with the associated car guide rail and is fastened to the at least one elevator unit. In the present context, the term "aligning" is to be understood as the positioning of an elevator unit within a horizontal plane while simultaneously aligning the elevator unit about a vertical axis.

The term "guide rail head" is to be understood as a thickened and usually machined part of the web of a car guide rail consisting of a T-profile with flange and web. In order to simplify the present description, instead of the term "guide rail head of a car guide rail" only the term "car guide rail" will be used in the following.

With the method according to the invention for installing an elevator, in which the aligned elevator unit is supported in the elevator shaft and subsequently the guide shoes of the elevator unit are brought into engagement with the respective associated car guide rails by an elevator installer and fastened to the elevator unit, it is achieved that the risk of damage to the car guide rails is reduced, that the risk of damage to the guide shoes and to the guide rails is virtually eliminated, that the installation personnel no longer have to precisely align the heavy elevator units suspended from the hoist and therefore the risk of accidents is reduced, and that the unproblematic fitting of car guide rails and associated guide shoes into one another considerably reduces the installation time and the use of the hoist (construction crane).

In one of the possible embodiments of the method, at least part of the guide devices is dismantled after the machine platform has been lowered into the elevator shaft and reused in the installation of another elevator system.

As a result, the cost of manufacturing such guide devices can be saved several times.

In another possible embodiment of the method, each guide device has at least one first and one second guide element which are arranged such that, when the at least one elevator unit—formed, for example, by the machine platform—is lowered, they cooperate with alignment elements attached to the machine platform or stationarily fixed in in the elevator shaft in such a manner that the at least one elevator unit is aligned. With the at least two guide elements each belonging to a guide device, it is achieved in a simple and cost-effective manner that when lowering the at least one elevator unit, the latter is aligned in such a manner that the guide shoes of the elevator unit can be brought into engagement with the car guide rails and mounted on the elevator unit, or that the upper ends of the car guide rails are inserted into guide shoes already fixed on the elevator unit.

The alignment elements and the guide devices are to be arranged in such a manner that during lowering, the elevator unit is aligned before the guide shoes of the elevator unit or their attachment points have reached the upper ends of the car guide rails.

In another possible embodiment of the method, at least one of the alignment elements is formed by a rod-shaped component having two parallel side faces and an end face perpendicular to these side faces.

This makes it possible that the same guide devices can cooperate with alignment elements fixed to the elevator shaft wall—for example with car guide rails—as well as with alignment elements attached to the respective at least one elevator unit—for example with rod-shaped alignment rails.

In another possible embodiment of the method, at least one of the alignment elements is formed by a car guide rail fixed to an elevator shaft wall—or by an upper region of such a car guide rail at the time of insertion of the at least one elevator unit into the elevator shaft.

This embodiment has the advantage that no additional structural elements are required to implement the alignment elements. Manufacturing and assembly costs are thus minimized.

In another possible embodiment of the method, at least one of the alignment elements is formed by an alignment rail attached to the at least one elevator unit and cooperating with a guide device fixed in the elevator shaft. In this case, the position of the guide device corresponds to the position of the alignment rail forming the alignment element in such a manner that when lowering the at least one elevator unit, the latter is aligned in such a manner that the guide shoes of the elevator unit can be brought into engagement with the car guide rails and subsequently can be mounted on the elevator unit, or that when lowering the at least one elevator unit, the car guide rail associated with the guide device is inserted into the guide shoe on the elevator unit associated with this car guide rail.

With this embodiment, a high degree of flexibility is achieved in the choice of the arrangement of the guide devices and the alignment elements.

In another possible embodiment of the method, the first and second guide elements are arranged approximately symmetrically with respect to a vertical plane of symmetry, wherein the two guide elements form a V-shaped guide channel which, when lowering the at least one elevator unit, cooperates with the alignment element associated with the guide device and, in the region of the narrowest point between the two guide elements, has a distance corresponding approximately to a horizontal width of the alignment element.

With this embodiment of the method, the desired alignment of the at least one elevator unit can be achieved by the simplest and most cost-effective means.

In the present specification, the term "vertical" is generally to be understood as the direction of extent of the elevator shaft or the direction of extent of the car guide rails of the elevator car of the elevator installation, and the term "horizontal" is to be understood, in the true meaning, as any direction which is directed perpendicularly to the direction of extent.

In another possible embodiment of the method, the first and the second guide elements are designed with approximately rectangular guide surfaces, wherein these guide surfaces are arranged with respect to the side and end faces of the associated alignment element and of the associated car guide rail, respectively, in such a manner that the guide surface of the first guide element faces a first one of the parallel side faces and the guide surface of the second guide element faces a second one of the parallel side aces of the alignment element, that the guide surfaces at least partially cover the side faces, that in each case a horizontal center line of the rectangular guide surfaces is perpendicular to the plane of the end face of the alignment element, that in each case a rising center line of the rectangular guide surfaces is arranged pivoted by in each case a guide angle $\alpha$ in opposite pivoting directions with respect to the parallel side faces of the alignment element, that both guide surfaces are arranged symmetrically with respect to a symmetry plane lying between the two side faces, wherein the smallest distance between the two guide surfaces corresponds approximately to the distance B between the parallel side faces of the alignment element.

With this embodiment of the method it is achieved that the guide devices can be produced systematically and inexpensively and function appropriately, and that they reduce the risk of accidents both during their assembly and when they are used as alignment aids.

In another possible embodiment of the method, the first and second guide elements are attached in such a manner that the guide angles $\alpha$ present between the rising center lines of the rectangular guide surfaces of these guide elements and the parallel side faces of the associated alignment element are between 10 degrees and 70 degrees, preferably between 20 degrees and 60 degrees, and particularly preferably between 30 degrees and 50 degrees.

This makes it possible to achieve an advantageous and proven alignment effect of the guide elements and thus a method that saves assembly time and cost.

In another possible embodiment of the method, the guide device, in the case of attachment of the guide device on the elevator unit to be lowered into the elevator shaft, is arranged in such a manner that the V-shaped guide channel or the guide angles α present between the rising center lines of the rectangular guide surfaces and the parallel side faces of the associated alignment element open downwards.

In this way it is achieved that when the at least one elevator unit is lowered into the elevator shaft, the desired alignment effect between the guide device attached to the elevator unit and a corresponding alignment element fixed in the elevator shaft is achieved.

In another possible embodiment of the method, the guide device, if the guide device is attached stationarily in the elevator shaft, is arranged in such a manner that the V-shaped guide channel or the guide angles α present between the rising center lines of the rectangular guide surfaces and the parallel side faces of the associated alignment element open upwards.

In this way it is achieved that when the at least one elevator unit is lowered into the elevator shaft, the desired alignment effect is achieved between the guide device fixed in the elevator shaft and a corresponding alignment element attached to the elevator unit.

In another possible embodiment of the method, at least one of the guide devices is provided with a third guide element, wherein a third guide surface of the third guide element is arranged, on the one hand, perpendicular to the side faces of the alignment element and, on the other hand, pivoted by a guide angle β with respect to the end face of the alignment element.

With such an embodiment of the method it is achieved that due to the cooperation of at least two guide devices, which are installed on opposite sides of the elevator units to be lowered, with respective corresponding alignment elements, an additional alignment effect also occurs, the effective direction of which lies transversely to the effective direction of the alignment effect effected by the first and the second guide elements.

In another possible embodiment of the method, the at least one elevator unit is formed by one of the following components of the elevator system guided by means of guide shoes on the car guide rails:

- the machine platform
- the elevator car
- a lifting platform which is temporarily fixed in the elevator shaft and is used as a support structure for lifting the machine platform as construction progresses.

By applying the method to a plurality of elevator units—i.e., by placing a plurality of pre-assembled components of the elevator system in the elevator shaft—, and by using the same guide devices for all elevator units, the cost for the installation of the elevator system can be further reduced.

Exemplary embodiments of the method according to the invention are explained below with reference to the accompanying drawings.

DESCRIPTION OF THE DRAWINGS

FIG. 2 shows a section of the elevator shaft of the elevator system according to FIG. 1 with a machine platform lowered into the elevator shaft, wherein guide devices arranged on the machine platform cooperate with car guide rails when the machine platform is lowered in order to align the machine platform in a position in which guide shoes aligned with the car guide rails can be mounted on the machine platform.

FIG. 2A and FIG. 2B show details of a guide device cooperating with a car guide rail.

FIG. 4 shows a section of the elevator shaft of the elevator system according to FIG. 1 with a machine platform lowered into the elevator shaft, wherein guide devices arranged on the elevator shaft wall cooperate with alignment rails mounted on the machine platform in order to align the machine platform in a position in which guide shoes aligned with the car guide rails can be mounted on the machine platform.

FIG. 4A and FIG. 4B show details of a guide device according to FIG. 4.

DETAILED DESCRIPTION

Figure 1A:
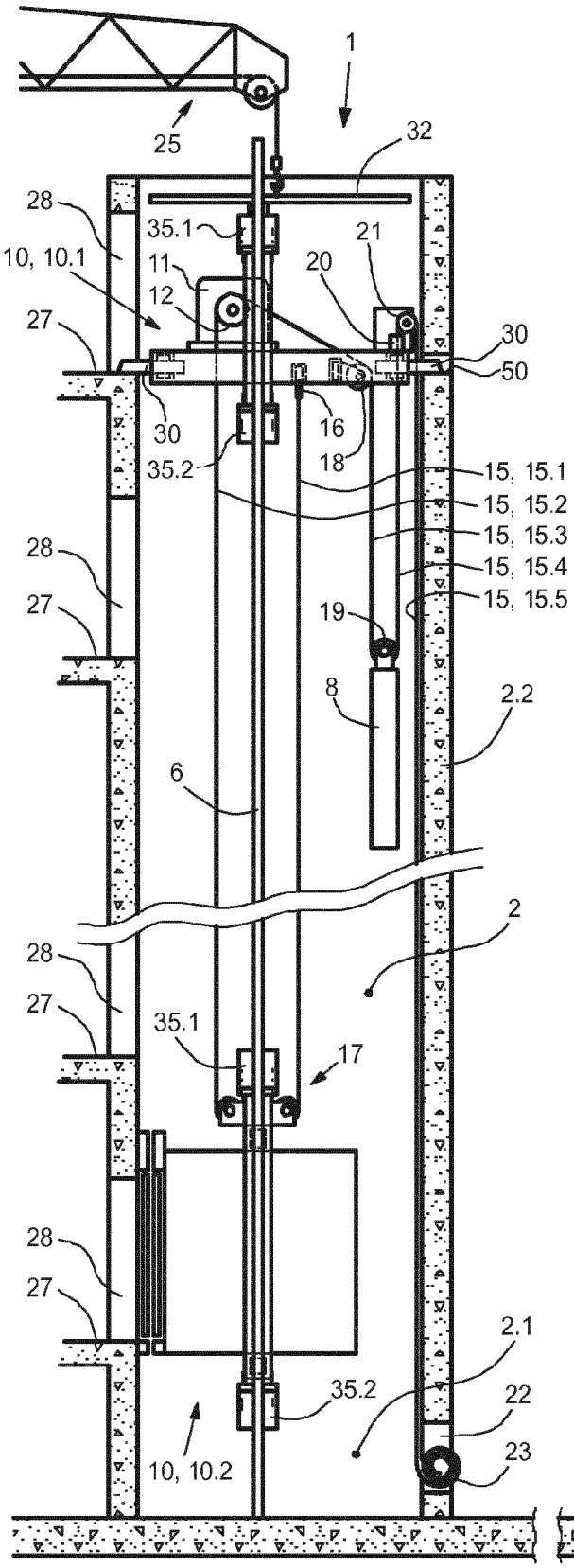
FIG. 1A schematically shows a front view an elevator system already installed and suitable for carrying out the method according to the invention.
Figure 1B:
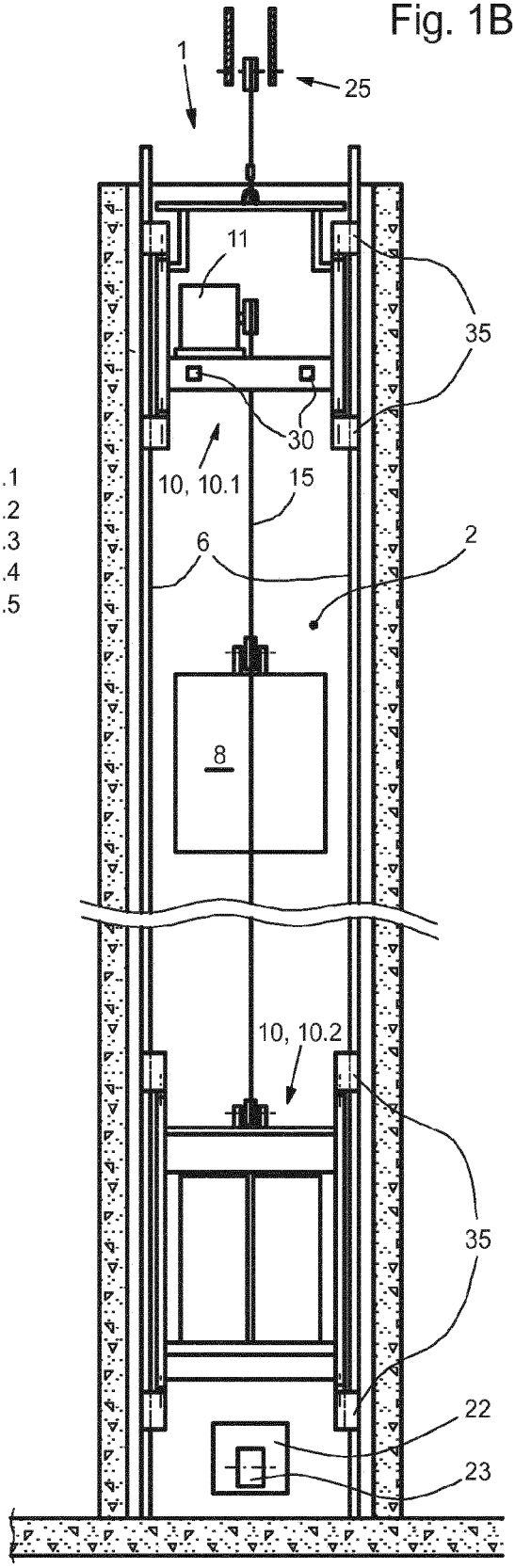
FIG. 1B schematically shows a side view of the elevator system according to FIG. 1A.

FIG. 1A schematically shows an elevator system 1 suitable for carrying out the method according to the invention and already installed in a front view, and FIG. 1B shows the elevator system 1 in a side view. The elevator system 1 is arranged in an elevator shaft 2 of a building under construction and comprises a plurality of elevator units 10 movable along car guide rails 6 in the elevator shaft 2. This group of elevator units includes the elevator car 10.2 and a machine platform 10.1 movable and lockable along car guide rails 6 in the elevator shaft 2 and having an elevator drive machine 11. The elevator system 1 may include a lifting platform 10.3 as a further elevator unit 10, which is explained below in connection with FIG. 6.

Furthermore, the elevator unit 1 comprises a counterweight 8 guided on counterweight guide rails which are not shown here. The elevator car 10.2 and the counterweight 8 are suspended from the machine platform 10.1 via an arrangement of suspension means 15, with the suspension means 15 being guided over a traction sheave 12 of the elevator drive machine 11 in such a manner that the elevator car 10.2 and the counterweight 8 can be driven in opposite directions by the elevator drive machine 11 via the suspension means 15. Preferably, wire ropes, synthetic fiber ropes or belt-like traction means reinforced with wire ropes or synthetic fiber ropes are used as suspension means. As can be seen from FIG. 1A, each of the suspension means 15 extends from a rope fixing point 16 present on the machine platform 10.1 to an arrangement of car support pulleys 17, are deflected there by 180 degrees, then extend upwardly from the arrangement of car support pulleys 17 to the traction sheave 12 of the elevator drive machine 11, are deflected by the traction sheave 12 to diverter or deflection pulleys 18, then extend downwardly to counterweight support pulleys 19, are deflected there by 180 degrees, and extend upwardly from the counterweight support pulleys 19 to a suspension means clamping device 20 attached to the machine platform 10.1. After the suspension means clamping device 20, the suspension means 15 continue to run upwards to deflection pulleys 21 likewise mounted on the machine platform, are deflected there by 180 degrees and then extend downwards in the elevator shaft 2 to rope storage devices 23 arranged in the region of the elevator shaft pit 2.1—preferably in a recess 22 of an elevator shaft wall 2.2.

The elevator system 1 is designed in such a manner that the usable lifting height of the elevator car 10.2 can be adapted to the increasing height of the building or elevator shaft 2 during the construction phase in that, on the one hand, the machine platform 10.1 is lifted by at least one floor height in the elevator shaft 2 by means of a construction crane 25 or another lifting device and is fixed at a new position—preferably at the level of a floor sill 27 of the building—and in that, on the other hand, an extension of the vertical suspension means portions 15.1-15.5 of the arrangement of suspension means 15 is carried out depending on the increase of the usable lifting height. The suspension means supply required for such an extension of the mentioned vertical sections of the suspension means is preferably kept ready in the rope storage device 23 and is fed into the arrangement of suspension means 15 in the respective required quantity when the machine platform is lifted for the purpose of increasing the usable lifting height. In order to carry out the extension of the suspension means, the counterweight 8 is preferably moved to its lower travel limit before the machine platform 10.1 is lifted, and then the elevator car 10.2 is coupled to the machine platform so that the suspension means are largely unloaded. The clamping of the suspension means clamping device 20 is now released, whereupon the machine platform 10.1 is lifted to its intended new position with the aid of the construction crane. While the machine platform and the elevator car 10.2 suspended therefrom are being lifted, the required quantity of suspension means is fed from the rope storage devices 23 via the deflection pulleys 21 and the opened suspension means clamping device 20 into the arrangement of suspension means 15. After the machine platform 10.1 has been fixed at its new level in the elevator shaft 2, the suspension means 15 are blocked again in the suspension means clamping device 20, and the coupling between the elevator car 10.2 and the machine platform 10.1 is released. The elevator system 1 is now substantially ready for elevator operation with an increased usable lifting height. The described procedure for increasing the usable lifting height of the elevator car can be repeated until the building or elevator shaft 2 has reached a final height. Preferably, the machine platform 10.1 is then definitely fixed in the elevator shaft as the final machine room floor of the elevator system 1.

In order to be able to raise the machine platform 10.1 along the elevator shaft 2 and then lock it again in the elevator shaft, the machine platform is equipped with retractable or extendable support elements 30. The machine platform 10.1 is preferably locked in place by extending the support elements 30 after the machine platform has been lifted so that they can be supported in recesses 50 in an elevator shaft wall 2.2 or in the region of a shaft door opening 28 on the floor sill 27.

To protect the assembly personnel as well as components of the elevator system from falling objects, the machine platform 10.1 is provided with a protective roof 32.

Both the machine platform 10.1 and the elevator car 10.2 are guided in vertically displaceable manner by means of upper and lower guide shoes 35.1, 35.2 on the car guide rails 6 provided in the final elevator system for guiding the elevator car 10.2.

Figure 6:
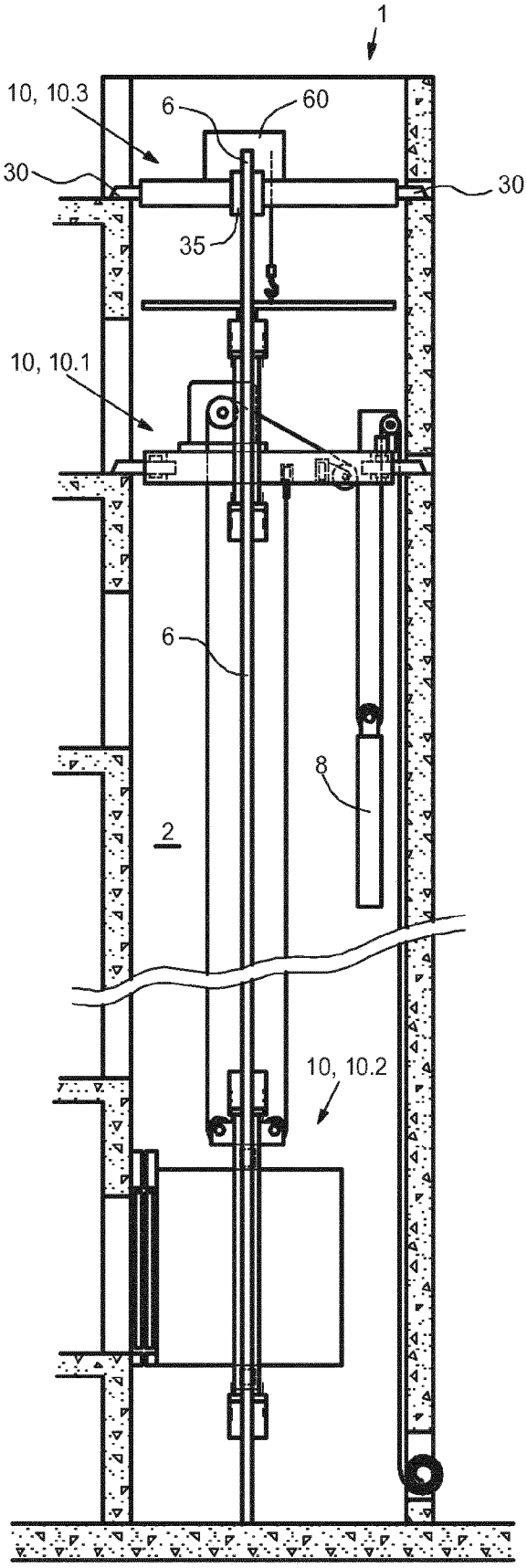
FIG. 6 shows an elevator system similar to the elevator system according to FIG. 1, in which not a construction crane is used to lift the machine platform, but a lifting platform equipped with a lifting device and guided on the car guide rails, which forms a further elevator unit.

As mentioned above, the elevator system 1 comprises a group of elevator units 10 guided by means of guide shoes 35.1, 35.2 on car guide rails 6, which group includes the vertically displaceable machine platform 10.1, the elevator car 10.2 and a lifting platform 10.3 used for lifting the machine platform (shown in FIG. 6). In the installation method according to the invention, at least one of these elevator units—preferably at least the machine platform 10.1—is not assembled in the elevator shaft 2 from individual components, but this at least one elevator unit 10 is inserted into the elevator shaft 2 as a pre-assembled unit by means of the construction crane 25 or another lifting device. In doing so, the at least one elevator unit 10 is lowered in the elevator shaft to a level at which the elevator unit can be temporarily locked in place and assembled with other elevator units to form an operational elevator system—with the usable lifting height of the elevator car 10.2 reduced in accordance with the currently available height of the elevator shaft. In order to bring the elevator unit into a position suitable for fitting its guide shoes 35.1, 35.2 and the respectively associated car guide rail 6 into one another when the at least one elevator unit 10 is lowered into the elevator shaft, guide devices mounted on the elevator unit or mounted stationarily in the elevator shaft are used, which cooperate with respectively associated alignment elements fixed stationarily in the elevator shaft 2 or attached to the at least one elevator unit 10. For this purpose, different embodiments of the method can be used.

FIG. 2 shows a first embodiment of the method on the basis of an example in which the at least one elevator unit 10 is formed by the machine platform 10.1 described above. The machine platform 10.1, which is pre-assembled outside the elevator shaft 2, substantially comprises a support frame 40 made, for example, from rectangular steel tubes by means of welding or bolting. Two vertically oriented guide shoe carriers 41 are connected to this support frame 40, at the upper and lower ends of which the guide shoes 35.1, 35.2 are attached in the operational state for guiding the machine platform 10.1 on the car guide rails 6 serving as alignment elements 5 in this embodiment. The following components belonging to the machine platform can also be seen on the machine platform: the elevator drive machine 11 with the traction sheave 12, the diverter pulleys 18 for diverting and guiding the suspension means (not yet installed in the installation phase shown), the suspension means clamping device 20, with which in each case a supporting portion of the suspension means is detachably fixed to the machine platform 10.1, the deflection pulley 21 for deflecting portions of the suspension means that are not loaded during elevator operation to the rope storage devices 23 (FIG. 1), the extendable and retractable support elements 30, via which the machine platform 10.1 can be supported in the elevator shaft 2, and the protective roof 32, which serves to protect against falling objects. In the embodiment of the method described in FIG. 2, guide devices 45 are mounted at the lower ends of the guide shoe carriers 41 of the machine platform 10.1 instead of lower guide shoes 35.2 in the illustrated phase of the method. The function of the mentioned guide devices 45 is explained below.

The machine platform 10.1, which was pre-assembled outside the elevator shaft 2, is shown in FIG. 2 in a situation in which it was brought into the elevator shaft 2 by lowering it by means of a lifting device—for example, a construction crane. It is supported and fixed in a position in the upper region of the elevator shaft that has currently already been constructed. At the time of installation of the machine platform or elevator system, the elevator shaft 2 has a height corresponding to the construction progress of the building, which corresponds to the height of a few floors—for example 5 floors. To support the machine platform 10.1, the support elements 30 are extended shortly before the machine platform has reached the intended level during lowering, whereafter the machine platform is lowered further until it rests via its support elements on bearing surfaces of the elevator shaft provided for this purpose—preferably on a floor sill 27 and in recesses 50 in the elevator shaft wall 2.2 opposite this floor sill.

As already mentioned, during lowering of the elevator unit 10 formed here by the machine platform 10.1 into the elevator shaft 2, two guide devices 45 are attached to the lower ends of the two guide shoe carriers 41 of the machine platform 10.1 instead of lower guide shoes 35.2. When the machine platform is lowered into the elevator shaft, these guide devices 45 cooperate with associated alignment elements 5 stationarily fixed in the elevator shaft—here with the car guide rails 6 serving as alignment elements 5—in such a manner that the at least one elevator unit 10 which is suspended on the rope of the lifting device 25 and is formed by the machine platform 10.1 is aligned in a position in which the upper and lower guide shoes 35.1, 35.2 of the elevator unit and the respective associated car guide rails 6 can be fitted into one another after the machine platform 10.1 has been supported in the elevator shaft 2 in the correct horizontal position. After the machine platform has been supported, the guide devices 45 are first dismantled. Subsequently, the guide shoes 35.1, 35.2 and the respective associated car guide rails 6 are fitted into one another, whereupon the guide shoes are fastened to the guide shoe carriers 41 of the elevator unit 10 formed by the machine platform 10.1.

FIGS. 2A and 2B schematically show the guide device 45 in a front view and a side view, respectively. The guide device substantially comprises at least one base plate 46 as well as a first guide element 47.1 and a second guide element 47.2, each of the guide elements having a planar, rectangular guide surface 47.1.1, 47.2.1. In the embodiment of the method explained here, the guide elements 47.1, 47.2 are arranged in the guide device 45 in such a manner that the at least one elevator unit 10 formed by the machine platform 10.1 is aligned when at least two guide devices 45 mounted on the elevator unit 10 cooperate with the respective associated alignment elements 5 stationarily fixed in the elevator shaft 2—formed here by the car guide rails 6—when the elevator unit is lowered. Preferably, rod-shaped structural elements extending parallel to the car guide rails 6 and having two parallel side faces and an end face perpendicular to the parallel side faces are used as alignment elements. In the embodiment shown in FIG. 2, the alignment elements 5 are formed by the car guide rails 6, which have the aforementioned parallel side faces 6.1, 6.2 and the end face 6.3 perpendicular to these side faces (see FIG. 2A). The first guide surface 47.1.1 and the second guide surface 47.2.1 of the two guide elements 47.1 and 47.2 are arranged approximately symmetrically with respect to a vertical plane of symmetry in the guide device 45, wherein a downwardly opening, V-shaped guide channel 45.1 is formed by the two guide surfaces. When the machine platform 10.1 forming the at least one elevator unit is lowered, this guide channel cooperates with the alignment element 5 associated with the guide device—formed here by the car guide rail 6—and, in the region of the narrowest point between the two rectangular guide surfaces 47.1.1, 47.2.1, has a distance corresponding approximately to the horizontal width B of the car guide rail 6.

In the case of a guide device 45 mounted on an elevator unit positioned in the elevator shaft 2—in FIG. 2 on the machine platform 10.1—the guide surfaces 47.1.1, 47.2.1 are arranged with respect to the side faces 6.1, 6.2 and the end faces 6.3 of the car guide rail 6, which here form the alignment element 5, in such a manner that the guide surface 47.1.1 of the first guide element 47.1 faces the first parallel side face 6.1 and the guide face 47.2.1 of the second guide element 47.2 faces the second parallel side face 6.2 of the car guide rail 6, that the guide faces 47.1.1, 47.2.1 at least partially overlap the two side faces 6.1, 6.2 of the car guide rail 6, that the horizontal center lines of the rectangular guide faces 47.1.1, 47.2.1 are perpendicular to the plane of the end face 6.3 of the car guide rail 6 forming the alignment element 5, that the rising center lines of the rectangular guide surfaces 47.1.1, 47.2.1 are each arranged pivoted by a guide angle $\alpha$ in opposite pivoting directions relative to the parallel side faces 6.1, 6.2 of the car guide rail 6, and that the two guide surfaces 47.1.1, 47.2.1 are arranged symmetrically with respect to a plane of symmetry lying between the parallel side faces 6.1, 6.2 of the alignment element 5, wherein the smallest distance between the two guide surfaces 47.1.1, 47.2.1 corresponds approximately to the distance B between the parallel side faces 6.1, 6.2 of the car guide rail 6 forming the alignment element 5.

Moreover, it can be seen in FIGS. 2A and 2B that at least one of the guide devices 45 can advantageously be provided with a third guide element 47.3, the third guide surface 47.3.1 of which creates an additional alignment effect by cooperating with the car guide rail 6 associated with the guide device and forming the alignment element 5, wherein the effective direction of this additional alignment effect is transverse to the effective direction of the alignment effect created by the first and second guide elements 47.1, 47.2. The guide surface 47.3.1 is arranged, on the one hand, perpendicular to the side faces 6.1 and 6.2 of the car guide rail 6 forming the alignment element 5 here and, on the other hand, arranged pivoted by a guide angle $\beta$ with respect to the end face 6.3 of the car guide rail.

The above description of the guide device and the alignment element cooperating with the guide device is also applicable to the guide devices and alignment elements described in connection with the other Figs. In this context, the guide devices can be attached to the at least one elevator unit or to elevator shaft walls in such a manner that the V-shaped guide channels of the guide devices open downwards or upwards. The alignment elements can be designed as car guide rails or as alignment rails attached to the elevator unit.

Figure 3:
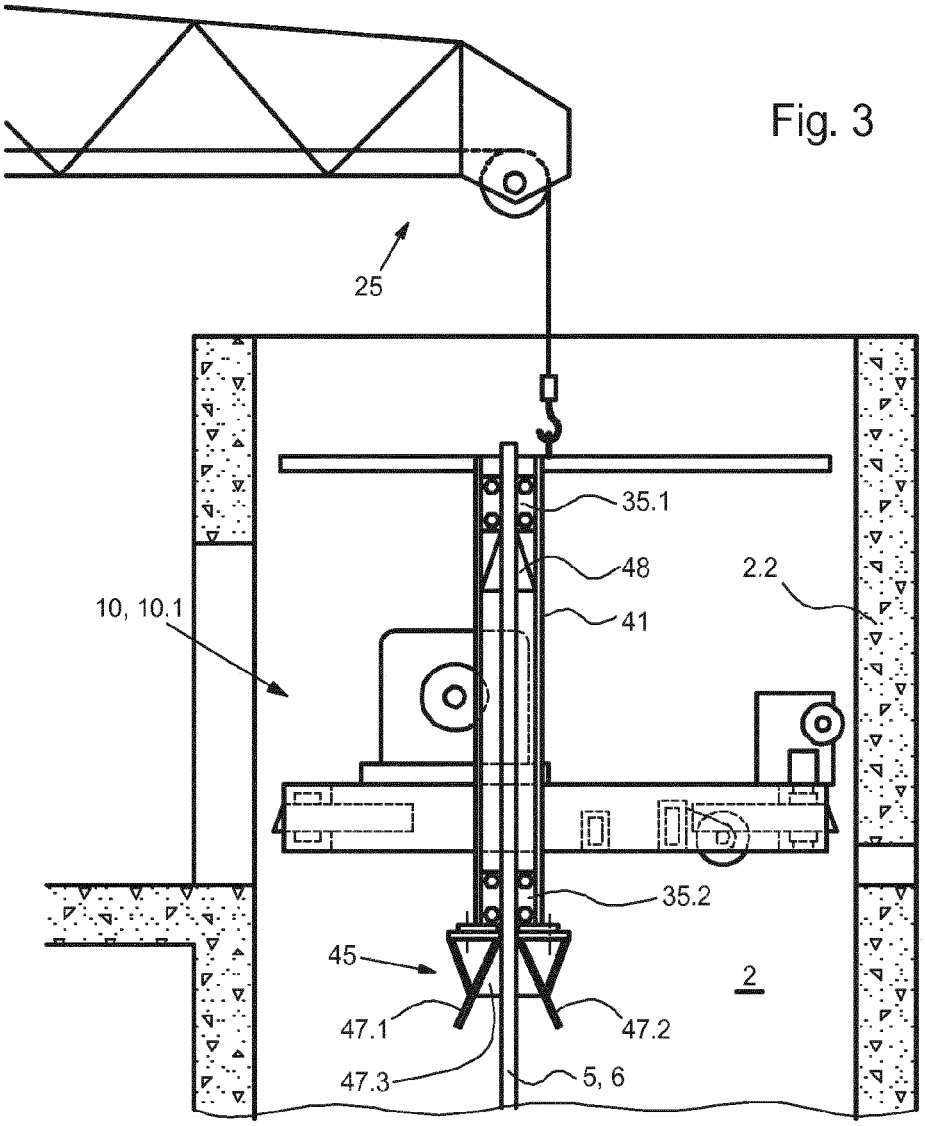
FIG. 3 shows a section of the elevator shaft of the elevator system according to FIG. 1 with a machine platform lowered into the elevator shaft, wherein guide devices arranged on the machine platform cooperate with car guide rails of the elevator car when the machine platform is lowered in order to guide the car guide rails directly into the guide shoes mounted on the machine platform.

FIG. 3 shows a second embodiment of the method. In this embodiment, too, a pre-assembled elevator unit 10—here likewise the machine platform 10.1 corresponding to the machine platform according to FIGS. 2A, 2B—is lowered into the elevator shaft 2 by means of the construction crane 25. When lowering the pre-assembled elevator unit formed by the machine platform 10.1, it is aligned with alignment elements 5 by means of guide devices 45 arranged on the pre-assembled elevator unit, as in the embodiment according to FIG. 2, which alignment elements in the embodiment according to FIG. 3 are also formed by car guide rails 6.

The embodiment according to FIG. 3 differs from the embodiment described in FIGS. 2, 2A, 2B in that, after the lowering of the pre-assembled elevator unit 10 formed by the machine platform 10.1 and the resulting alignment of the elevator unit, this elevator unit is not supported in the elevator shaft in order to subsequently bring guide shoes 35 (FIG. 1B), which have not yet been attached to the elevator unit, into engagement with the car guide rails 6 and to mount them on the elevator unit. In the embodiment described in FIG. 3, the upper and lower guide shoes 35.1, 35.2 of the machine platform 10.1 forming the elevator unit 10 as well as the guide devices 45 are already attached and fixed to the pre-assembled elevator unit before the elevator unit is inserted into the elevator shaft 2 and lowered therein. The guide devices 45 are identical to the guide devices 45 shown mainly in FIGS. 2A, 2B and are mounted in the same manner on the elevator unit 10. In the course of the lowering process, the guide elements 47.1-47.3 of the guide devices 45 mounted below the elevator unit come into contact with the momentarily upper ends of the car guide rails 6 already fixed to elevator shaft walls 2.2 and forming here the alignment elements 5. Upon further lowering of the elevator unit, the latter is aligned by the guide devices 45 cooperating with the alignment elements 5 or with the mentioned guide rails 6 into a position from which, upon further lowering of the elevator unit, the car guide rails 6 are inserted into the guide shoes 35.1, 35.2 arranged on the elevator unit 10 formed by the mounting platform 10.1. Subsequently, the elevator unit can be lowered to a level provided for it in the elevator shaft 2 and supported there at least temporarily. As can be seen from FIG. 3, auxiliary guide devices 48 can be mounted below the upper guide shoes 35.1 of the elevator unit 10, 10.1, which facilitate automatic insertion of the car guide rails 6 into the upper guide shoes 35.1 when the aligned elevator unit is lowered and the elevator unit is not suspended perfectly horizontally from the rope of the construction crane 25.

Figure 3A:
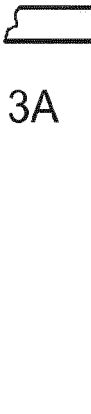
FIG. 3A and FIG. 3B show an auxiliary guide device arranged on a guide shoe carrier of the machine platform according to FIG. 3, by means of which a car guide rail is guided into an upper guide shoe of the machine platform during lowering.
Figure 3B:
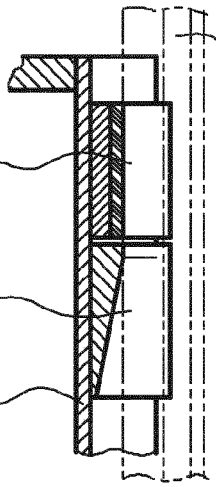

FIG. 3A shows an enlarged front view of a preferred arrangement variant of an upper guide shoe 35.1 of the elevator unit 10 formed here by the machine platform 10.1 as well as an auxiliary guide device 48 associated with this guide shoe. Both the guide shoes 35.1, 35.2 and the auxiliary guide device 48 are fixed to the U-shaped guide shoe carrier 41 fastened to the supporting frame 40 (FIG. 2) of the machine platform before the machine platform 10.1 is inserted into the elevator shaft 2. FIG. 3B shows a sectional view of the arrangement of these components and their relation to the car guide rail 6 forming the alignment element 5 in a side view corresponding to FIG. 3A.

FIG. 4 shows a third embodiment of the method, in which likewise an elevator unit 10 pre-assembled outside the elevator shaft 2 and formed by the machine platform 10.1 is lowered into the elevator shaft 2 by means of the construction crane 25. The embodiment shown in FIG. 4 differs from the embodiments explained in connection with FIGS. 2 and 3 in that during the lowering, the at least one elevator unit 10 formed by the machine platform 10.1 is not aligned with respective associated guide devices fixed to elevator shaft walls 2.2 of the elevator shaft 2 by the cooperation of two guide devices mounted on the machine platform, but by the cooperation of at least two guide devices 45 mounted stationarily on opposite elevator shaft walls 2.2 in the elevator shaft 2 with respective alignment elements 5 formed by alignment rails 7 and attached to the elevator unit on both sides thereof.

FIG. 4A shows one of the guide devices 45—which are substantially identical in construction to the guide devices described in connection with FIGS. 2, 2A, 2B—in combination with the upper portion of an alignment rail 7 associated with the guide device in an enlarged front view. FIG. 4B shows a vertical section through the arrangement according to FIG. 4A. The alignment rail 7 forming the alignment element 5 here—like the car guide rails 6 described in FIGS. 2 and 3—has two parallel side faces 7.1, 7.2 and an end face 7.3 perpendicular to these side faces, wherein the distance B between the parallel side faces forms the horizontal width of the alignment element 5, which corresponds approximately to the smallest distance between the two guide elements 47.1, 47.2 of the guide device. In the embodiment according to FIGS. 4A, 4B, the guide devices 45 are arranged in the elevator shaft in such a manner that the V-shaped guide channel 45.1 formed by the guide elements 47.1, 47.2 or the guide angle $\alpha$ present between the rising center line of in each case a rectangular guide surface 47.1.1, 47.2.1 (FIG. 2A) and the parallel side faces 7.1, 7.2 of the associated alignment rail 7, here forming the alignment element 5, opens upwards.

In the embodiment of the method described in FIGS. 4, 4A, 4B, neither guide devices 45 nor guide shoes 35.1, 35.2 are mounted on the lower ends of the guide shoe carriers 41 of the machine platform 10.1 provided for this purpose during lowering of the machine platform 10.1 forming the at least one elevator unit 10. In each case one guide device is fixed to in each case one of two opposing shaft walls, and alignment elements 5 in the form of alignment rails 7 cooperating with these guide devices 45 are mounted on the machine platform 10.1. The function of the guide devices 45 and the associated alignment elements 5 is explained below.

The machine platform 10.1 forming the at least one elevator unit 10, which was pre-assembled outside the elevator shaft 2, is shown in FIG. 4 in a position into which it was brought in an initial phase of the elevator installation by lowering it into the elevator shaft 2—for example by means of a construction crane 25. The machine platform 10.1 is temporarily supported and fixed to the elevator shaft in a position in the upper region of the elevator shaft currently already constructed. At the time of installation of the elevator unit or the machine platform 10.1, the elevator shaft 2 has a height corresponding to the construction progress of the building, which corresponds to the height of a few floors—for example 5 floors. To support the machine platform 10.1, the support elements 30 are extended shortly before the machine platform reaches the intended level during lowering, whereupon the machine platform is lowered further until it rests via its support elements on bearing surfaces provided for this purpose in the elevator shaft—preferably on a floor sill 27 and in recesses 50 in the elevator shaft wall 2.2 facing this floor sill.

Before the elevator unit 10, formed here by the machine platform 10.1, is lowered into the elevator shaft 2, in each case one vertically oriented alignment element 5 formed by an alignment rail 7 is mounted on two opposite sides of the machine platform on the outside of the support frame 40, and in each case one guide device 45 aligned with in each case one of the alignment elements 5 is fixed to each of two elevator shaft walls 2.2 parallel to the mentioned sides of the machine platform 10.1. In doing so, the guide devices are mounted at a height at which it is ensured that, when the elevator unit is lowered into the elevator shaft, the lower ends of the alignment rails 7 forming the alignment elements 5 are already aligned by the guide elements 47.1, 47.2, 47.3 of the guide devices 45 before the lower ends of the guide shoe carriers 41 have reached the upper ends of the already installed car guide rails 6. The elevator unit can then be lowered further without the car guide rails already fixed to the elevator shaft walls colliding with the guide shoe supports 41 or with supports provided thereon for fixing the guide shoes. During further lowering of the elevator unit 10 formed by the machine platform 10.1, the guide devices 45 fixed stationarily in the elevator shaft 2 cooperate with the respective associated alignment elements 5 mounted on the elevator unit 10 in such a manner that the at least one elevator unit suspended from the rope of the hoisting device 25 remains in the aligned position. After the machine platform 10.1 forming the elevator unit 10 here has been supported in the elevator shaft 2 in the correct horizontal position shown in FIG. 4, the upper and lower guide shoes 35.1, 35.2 and the respective associated car guide rails 6 can be fitted into one another, and the guide shoes 35.1, 35.2 can be mounted and fixed—for example by a fitter—to the guide shoe carriers 41 of the machine platform 10.1.

Figure 5:
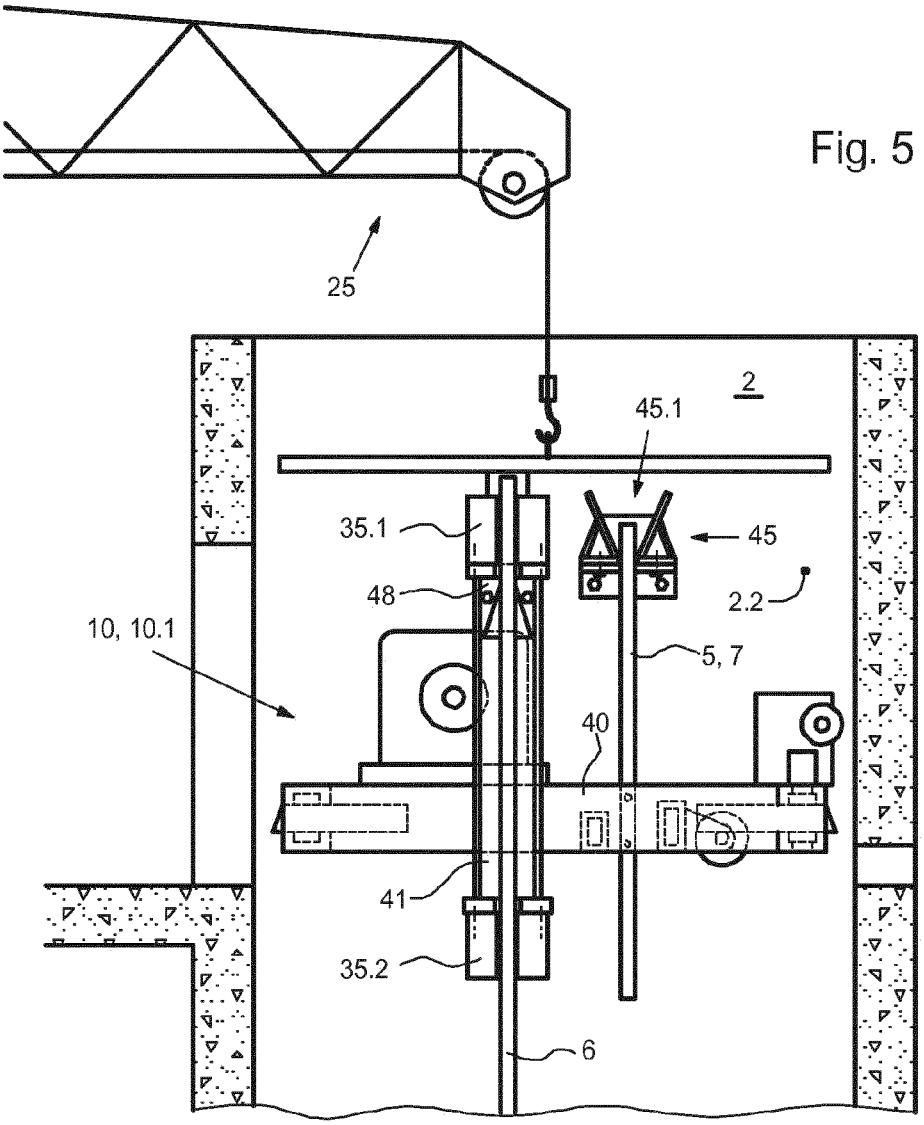
FIG. 5 shows a section of the elevator shaft of the elevator system according to FIG. 1 with a machine platform lowered into the elevator shaft, wherein guide devices arranged on the elevator shaft wall cooperate with alignment rails mounted on the machine platform in order to align the machine platform in a position to guide the car guide rails directly into the guide shoes mounted on the machine platform.

FIG. 5 shows a fourth embodiment of the method, in which an elevator unit 10 pre-assembled outside the elevator shaft 2 and, in the present example, formed by the machine platform 10.1 is likewise lowered into the elevator shaft 2 by means of the construction crane 25. The embodiment shown in FIG. 5 differs from the embodiment explained in connection with FIG. 4 in that during the lowering of the machine platform into the elevator shaft, the upper and lower guide shoes 35.1, 35.2 are already mounted on the elevator unit 10. As in the embodiment according to FIG. 4, in each case one guide device 45 with a guide channel 45.1 opening upwards is stationarily mounted on two opposing elevator shaft walls 2.2. On the sides of the machine platform 10.1 which face the elevator shaft walls with the guide devices 45, in each case one alignment rail 7 is mounted, which is aligned in the vertical direction with the associated guide device 45 and serves as an alignment element 5.

The guide devices 45 and the alignment rails 7 are positioned relative to one another in the vertical direction in such a manner that during the lowering of the machine platform 10.1 into the elevator shaft 2, the lower ends of the alignment rails are already aligned and guided by the guide devices before the lower guide shoes 35.2 of the machine platform have reached the currently upper ends of the car guide rails 6. Upon further lowering of the machine platform 10.1, which has been aligned by the cooperation of the guide devices 45 with the alignment rails 7, the lower guide shoes 35.2 of the machine platform first engage with the car guide rails 6—which are preferably slightly chamfered at their upper ends. Upon further lowering of the aligned machine platform 10.1, the upper guide shoes 35.1 also come into engagement with the car guide rails 6. In order to ensure that the upper ends of the car guide rails 6 can be inserted into the upper guide shoes 35.1 of the machine platform 10.1 even if the machine platform is not exactly in a horizontal position, auxiliary guide devices 48 can be arranged on the guide shoe supports 41 of the machine platform 10.1 below the mentioned upper guide shoes 35.1. Such auxiliary guide devices 48, which are difficult to dismantle in the arrangement shown, are preferably made of plastics or hardwood or are formed by welded parts integrated into the guide shoe supports 41. After both the lower and upper guide shoes 35.2, 35.1 of the elevator unit 10 formed here by the machine platform 10.1 have engaged with the car guide rails 6, the elevator unit can be lowered to their intended position and supported in the elevator shaft.

Figure 5A:
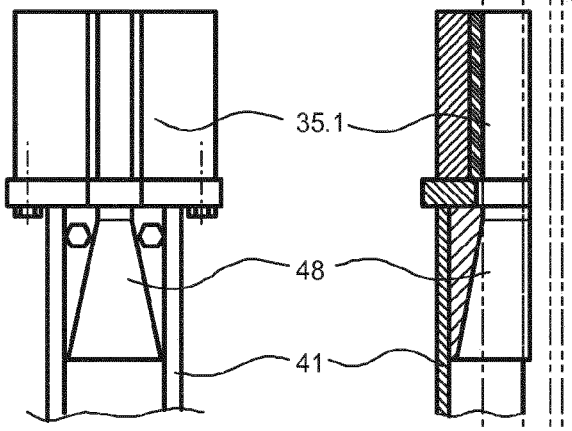
FIG. 5A and FIG. 5B show an auxiliary guide device arranged on a guide shoe carrier of the machine platform, by means of which a car guide rail is guided into an upper guide shoe of the machine platform during lowering.
Figure 5B:
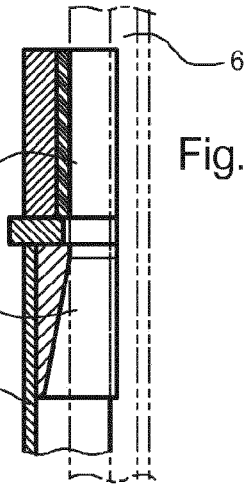

FIGS. 5A and 5B show a front view and a side view shown as a sectional view of an upper end of a guide shoe carrier 41 with an upper guide shoe 35.1 mounted on the latter and with the aforementioned auxiliary guide device 48. From these illustrations, it can be seen how the auxiliary guide device 48 helps during the lowering of the machine platform 10.1 forming the elevator unit to guide the upper guide shoes 35.1 mounted thereon and the upper ends of the car guide rails 6—shown as dotted lines in FIG. 5B—into each other.

FIG. 6 shows a slightly modified embodiment of the elevator system 1 shown in FIG. 1, in which the usable lifting height of the elevator car 10.2 is likewise adapted to an increasing height of a building or elevator shaft 2 in its construction phase. However, in contrast to the elevator system according to FIG. 1, in the elevator system according to FIG. 6, the machine platform 10.1, which carries the elevator car 10.2 and the counterweight 8, is not lifted from time to time with the aid of a construction crane, but this lifting of the machine platform 10.1 is carried out by means of a lifting platform 10.3 equipped with a lifting device 60 and forming a further elevator unit 10.

The advantage of this embodiment is that for the lifting of the machine platform 10.1 to be carried out from time to time, no construction crane with a lifting force sufficient for lifting the machine platform needs to be available. For the lifting of the substantially lighter lifting platform 10.3 required before each lifting of the machine platform 10.1, a light lifting device (not shown in FIG. 6) fixed above the lifting platform 10.3 by means of a support element in the elevator shaft is sufficient.

Of course, before each lifting of the lifting platform 10.3, the light lifting device and the associated supporting element must also be placed correspondingly further up in the elevator shaft. If no construction crane is available for lifting the light lifting device at the given time of lifting the lifting platform, both the carrying element and the light lifting device can be transported to a higher level via the stairwell, for example.

The lifting platform 10.3 described above, which can be lifted in the elevator shaft 2, is also guided on the car guide rails 6 by guide shoes 35 mounted on the lifting platform. After the insertion of the elevator car 10.2, the counterweight 8 and the machine platform 10.1 into the elevator shaft 2 has been carried out in the first phase of the installation method proposed here, the lifting platform 10.3 in the embodiment described here is also inserted into the elevator shaft 2 in the pre-assembled state by means of a construction crane, lowered to an intended level in the elevator shaft and supported there via support elements 30 in the elevator shaft. In order to bring the guide shoes 35 of the lifting platform 10.3 forming a further elevator unit into engagement with the car guide rails 6 with minimal effort and risk of accident, the mentioned lifting platform 10.3 is also aligned in the elevator shaft during the lowering by the cooperation of guide devices and corresponding alignment elements. The different variants of the alignment process and the guide devices and alignment elements used for this purpose are the same as described above in connection with FIGS. 2-5.

At least the guide devices 45 attached to the elevator shaft walls 2.2 or to the elevator units 10—but preferably also the alignment rails 7 serving as alignment elements 5 and fixed to the elevator units 10—are each dismantled after the elevator units have been lowered into the elevator shaft and the guide shoes 35.1, 35.2 of the elevator units have been brought into engagement with the car guide rails 6. The dismantled elements are reused when lowering further elevator units in the same building or when lowering elevator units in other elevator systems.

Advantageously, at least the guide elements 47.1-47.3 of the guide devices 45 are made of an impact-absorbing and/or friction-reducing material, or at least the guide surfaces 47.1.1-47.3.1 of the guide elements 47.1-47.3 are coated with such a material. In this manner it is achieved that during the lowering of the at least one elevator unit 10 into the elevator shaft 2 and the alignment process taking place in the course of this, the alignment effect is improved and the alignment elements 5, which cooperate with the guide devices 45 and are formed by car guide rails 6 or alignment rails 7, are not damaged.

In accordance with the provisions of the patent statutes, the present invention has been described in what is considered to represent its preferred embodiment. However, it should be noted that the invention can be practiced otherwise than as specifically illustrated and described without departing from its spirit or scope.

| Reference list | |
|---|---|
| 1 | Elevator system |
| 2 | Elevator shaft |
| 2.1 | Elevator shaft pit |
| 2.2 | Elevator shaft wall |
| 5 | Alignment element |
| 6 | Car guide rail |
| 6.1, 6.2 | Side face of car guide rail |
| 6.3 | End face of car guide rail |
| 7 | Alignment rail |
| 7.1, 7.2 | Side face of alignment rail |
| 7.3 | End face of alignment rail |
| 8 | Counterweight |
| 10 | Elevator unit |
| 10.1 | Machine platform |
| 10.2 | Elevator car |
| 10.3 | Lifting platform |
| 11 | Elevator drive machine |
| 12 | Traction sheave |
| 15 | Suspension means |
| 15.1-15.5 | Suspension means portions |
| 16 | Rope fixing point |
| 17 | Car support pulley |
| 18 | Diverter pulley |
| 19 | Counterweight support pulley |
| 20 | Suspension means clamping device |
| 21 | Deflection pulley |
| 22 | Recess (in shaft wall) |
| 23 | Rope storage device |
| 25 | Construction crane |
| 27 | Floor sill |
| 28 | Shaft door opening |
| 30 | Support element |
| 32 | Protective roof |
| 35 | Guide shoe |
| 35.1 | Upper guide shoe |
| 35.2 | Lower guide shoe |
| 40 | Support frame |
| 41 | Guide shoe carrier |
| 45 | Guide device |
| 45.1 | Guide channel |

-continued

| Reference list | |
|---|---|
| 46 | Base plate |
| 47.1 | First guide element |
| 47.2 | Second guide element |
| 47.3 | Third guide element |
| 47.1.1 | First guide surface |
| 47.2.1 | Second guide surface |
| 47.3.1 | Third guide surface |
| 48 | Auxiliary guide device |
| 50 | Recess (in elevator shaft wall) |
| 60 | Lifting device |

The invention claimed is:

1. A method for installing an elevator system in an elevator shaft of a building in its construction phase, the elevator system including an elevator car guided along the elevator shaft on car guide rails and a machine platform having a drive machine, the machine platform being displaceable along the elevator shaft on the car guide rails and adapted to be temporarily fixed in the elevator shaft, wherein the elevator car is suspended from the machine platform via suspension means and is moved in the elevator shaft by the drive machine, wherein a usable lifting height of the elevator car is adapted from time to time to an increasing height of the building by lifting the machine platform to a higher level in the elevator shaft, the method comprising the steps of:

lowering a pre-assembled elevator unit by a lifting device into the elevator shaft having the car guide rails;

using guide devices cooperating with alignment elements to align the elevator unit when lowered into the elevator shaft in a position for fitting guide shoes of the elevator unit and associated ones of the car guide rails into one another, wherein either the guide devices are mounted on the elevator unit and the alignment elements are fixed in the elevator shaft, or the guide devices are fixed in the elevator shaft and the alignment elements are mounted on the elevator unit;

supporting the elevator unit, at an end of the lowering, in a region of the elevator shaft equipped with the car guide rails in the position for fitting the guide shoes and the associated car guide rails into one another; and bringing at least one of the guide shoes into engagement with the associated car guide rail and fastening the at least one guide shoe to the elevator unit.

2. The method according to claim 1 including after lowering the elevator unit into the elevator shaft, dismantling at least part of the guide devices and reusing the at least part of the guide devices in an installation of another elevator system.

3. The method according to claim 1 wherein each of the guide devices includes a first guide element and a second guide element that are arranged to cooperate, during the lowering of the elevator unit, with the associated alignment element to align the elevator unit.

4. The method according to claim 1 wherein at least one of the alignment elements is rod-shaped having two parallel side faces and an end face perpendicular to the side faces.

5. The method according to claim 1 wherein at least one of the alignment elements is one of the car guide rails fixed to an elevator shaft wall of the elevator shaft.

6. The method according to claim 1 wherein at least one of the alignment elements is an alignment rail mounted on the elevator unit and cooperating with one of the guide devices fixed in the elevator shaft.

7. The method according to claim 1 wherein each of the guide devices includes a first guide element and a second guide element that are arranged to cooperate, during the lowering of the elevator unit, with an associated one of the alignment elements to align the elevator unit in the elevator shaft, the first and second guide elements being arranged symmetrically with respect to a vertical plane of symmetry to form a V-shaped guide channel that, during the lowering of the elevator unit, cooperates with the associated alignment element and, in a region of a narrowest point between the first and second guide elements, the guide channel has a distance larger than a horizontal width of the associated alignment element.

8. The method according to claim 7 wherein:

at least one of the alignment elements is rod-shaped having two parallel side faces and an end face perpendicular to the side faces;

the first and second guide elements of the guide device associated with the at least one alignment element have rectangular guide surfaces arranged with respect to the side faces and the end face of the associated alignment element;

whereby the guide surface of the first guide element faces a first one of the side faces and the guide surface of the second guide element faces a second one of the side faces and the guide surfaces at least partially cover the side faces;

horizontal center lines of the rectangular guide surfaces are perpendicular to the end face and rising center lines of the guide surfaces are arranged pivoted by a predetermined guide angle in opposite pivoting directions with respect to the side faces;

the guide surfaces are arranged symmetrically with respect to a plane of symmetry lying between the side faces; and a smallest distance between the guide surfaces corresponds to a distance between the side faces of the associated alignment element.

9. The method according to claim 8 wherein the first and second guide elements are arranged such that the guide angles between the rising center lines of the guide surfaces and the side faces of the associated alignment element are between 10 degrees and 70 degrees.

10. The method according to claim 8 wherein the first and second guide elements are arranged such that the guide angles between the rising center lines of the guide surfaces and the side faces of the associated alignment element are between 20 degrees and 60 degrees.

11. The method according to claim 8 wherein the first and second guide elements are arranged such that the guide angles between the rising center lines of the guide surfaces and the side faces of the associated alignment element are between 30 degrees and 50 degrees.

12. The method according to claim 8 wherein when the guide devices are attached to the elevator unit, the associated guide device is arranged such that the V-shaped guide channel opens downwards.

13. The method according to claim 8 wherein when the guide devices are fixed in the elevator shaft, the associated guide device is arranged such that the V-shaped guide channel opens upwards.

14. The method according to claim 8 wherein the associated guide device includes a third guide element having a third guide surface arranged in a plane perpendicular to the side faces of the at least one alignment element and pivoted by another predetermined guide angle with respect to the end face of the at least one alignment element.

15. The method according to claim 1 wherein the elevator unit is one of:

the machine platform;

the elevator car; and a lifting platform temporarily fixed in the elevator shaft and used as a support structure for lifting the machine platform as the construction phase progresses.

* * * * *